US006269575B1

(12) United States Patent
Chang

(10) Patent No.: US 6,269,575 B1
(45) Date of Patent: Aug. 7, 2001

(54) LOCKING DEVICE FOR THE TRIGGER OF A PISTOL

(76) Inventor: Wen-Kwei Chang, P.O. Box 82-144, Taipei (TW)

( * ) Notice: Subject to any disclaimer, the term of this patent is extended or adjusted under 35 U.S.C. 154(b) by 0 days.

(21) Appl. No.: 09/375,402

(22) Filed: Aug. 17, 1999

(51) Int. Cl.[7] ..... F41A 17/00
(52) U.S. Cl. ..... 42/70.07
(58) Field of Search ..... 42/70.06, 70.07; 70/291, 315

(56) References Cited

U.S. PATENT DOCUMENTS 3,624,945 * 12/1971 Foote .
3,637,180 * 1/1972 Parry .
4,499,681 * 2/1985 Bako et al. .
5,638,627 * 6/1997 Klein et al. .
5,647,158 * 7/1997 Eskelinen et al. .
5,704,152 * 1/1998 Harrison et al. .
5,832,647 * 11/1998 Ling et al. .
5,899,102 * 5/1999 Ling .

* cited by examiner

*Primary Examiner*—Charles T. Jordan
*Assistant Examiner*—Troy Chambers
(74) *Attorney, Agent, or Firm*—A & J

(57) ABSTRACT

A locking device for the trigger of a pistol is disclosed, and comprises a first and a second clipping seat, wherein the first clipping seat is provided with a hollow slot having a stopping block being mounted with a plurality of ratchet wheels. The second clipping seat is provided with a locking seat and a geared-shaft with a plurality of ratchet wheel. The first and the second clipping seat can combined together and the geared-shaft is inserted within the hollow slot. The clipping seats mount to the trigger and the trigger guard of a pistol from the lateral side thereof, so that the pistol trigger cannot be operated if the locking device is at the locking position.

1 Claim, 3 Drawing Sheets

LOCKING DEVICE FOR THE TRIGGER OF A PISTOL

BACKGROUND OF THE INVENTION a) Technical Field of the Invention

The present invention relates to a locking device for the trigger of a pistol, and in particular, relates to a locking device comprising a first and a second clipping seat to mount the trigger and the trigger guard of a pistol, such that the trigger cannot be operated unless the locking device is unlocked.

b) Description of the Prior Art

ROC patent publication no. 272 628 entitled "locking apparatus for trigger" relates to a locking apparatus comprising a fixing seat and an engaging seat. A cover is used to covers the fixing seat, and a pad is provided to one edge of the fixing seat. The engaging seat, adjacent to the fixing seat, is also provided with a pad, characterized in that a locking core is provided to the fixing seat and forms integrally with a combination shaft as one unit. One lateral edge of the combination shaft is provided with a ratchet face and the combination shaft can be inserted into a recess within the engaging seat, and the ratchet face is in engagement with the ratchet face of the stopping block of the engaging seat. This provides a locking to the trigger. When the two ratchet faces are separated, it is at a unlocking position.

The drawback of the above locking apparatus is that a key is needed to insert into the locking core to rotate the combination shaft so that the two ratchet face will separate from each other. If the key is unavailable or lost, the trigger cannot be operated. Another disadvantage is that a locksmith has to be hired to unlock the locking apparatus. Thus, it incurs expenses for such an operation.

SUMMARY OF THE INVENTION

Accordingly, it is an object of the present invention to provide a locking device for the trigger of a pistol comprising a first and a second clipping seat, wherein the first clipping seat is provided with a hollow slot having a stopping block mounted with a plurality of ratchet wheels, the second clipping seat is provided with a locking seat and a geared-shaft slot, and a number combination locker is provided to the locking seat, a geared-shaft is provided to the geared-shaft slot and is mounted with a plurality of ratchet wheels, and the geared-shaft is adapted for the hollow slot, characterized in that a cut face is provided to the circular end of the geared-shaft and the top face of the geared-shaft is provided with a rotating button, and when the cut face is restricted by the control board of the number combination locker, the geared-shaft cannot be rotated and the trigger is at the locking position, and when the number wheels of the number combination locker is rotated to a correct number, the control board is free to retract and the cut face of the geared-shaft is not engaged with the control board, the geared-shaft is free to rotate, and the ratchet wheel of the geared-shaft and the ratchet wheel (42) with the stopping block (17) are thus disengaged, and the trigger is at the unlocking position.

It is yet another object of the present invention to provide a locking device for the trigger of the pistol, wherein the combination numeral of the number combination locker to unlock the locking device can be re-adjusted or re-set.

BRIEF DESCRIPTION OF THE DRAWINGS

The foregoing and other objects of the invention will become apparent in reading the following detailed description and in reference to the following drawings, in which.

DETAILED DESCRIPTION OF THE PREFERRED EMBODIMENT

Figure 1:
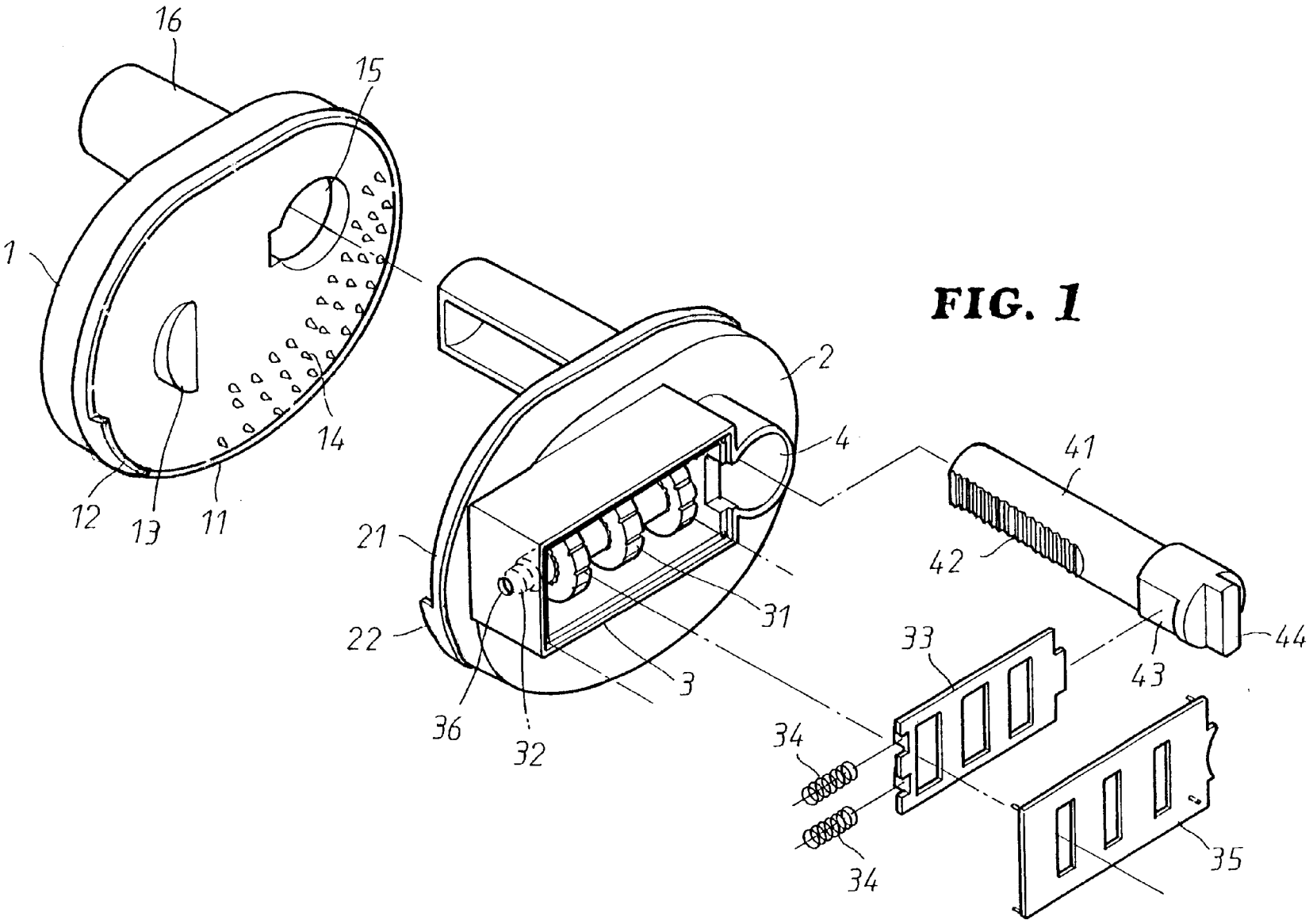
FIG. 1 is an exploded perspective view of the locking device for the trigger of a pistol in accordance with the present invention.
Figure 2:
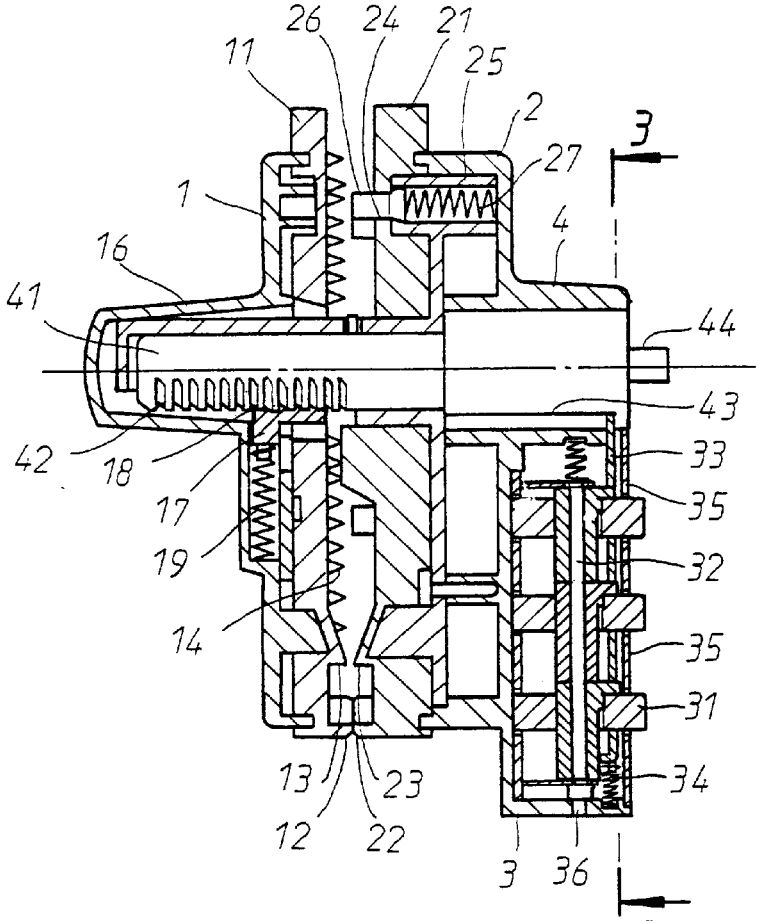
FIG. 2 is a sectional view showing the internal structure of the locking device at locking position in accordance with the present invention.

Referring to FIGS. 1 and 2, the present locking device for the trigger of a pistol essentially comprises a first and a second clipping seat 1, 2. The corresponding surface of the first clipping seat 1 and the second clipping seat 2 are provided with a first and a second soft pad 11, 21, wherein the first soft pad 11 is provided with a positioning disc 12, a slant face 13, a plurality of conic elements 14, and an opening 15, and the second soft pad 21 is provided with a positioning disc 22, a slant face 23, and an opening 24. An elongated tube 25, a retractable shaft 26, and a spring 27 (as shown in FIG. 2) are provided in between the second clipping seat 2 and the soft pad 21.

The details of these parts are not further described as the same are similar to the structure of a conventional locking device.

Figure 3:
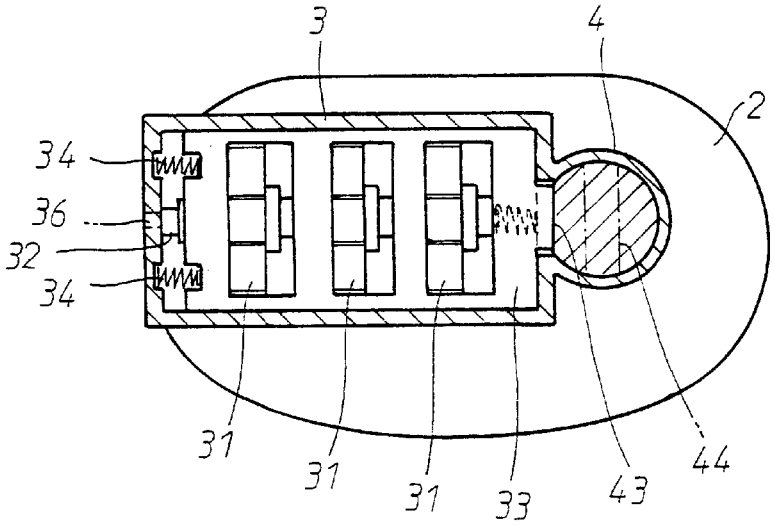
FIG. 3 is a sectional view along line 3—3 of FIG. 2 of the present invention.
Figure 4:
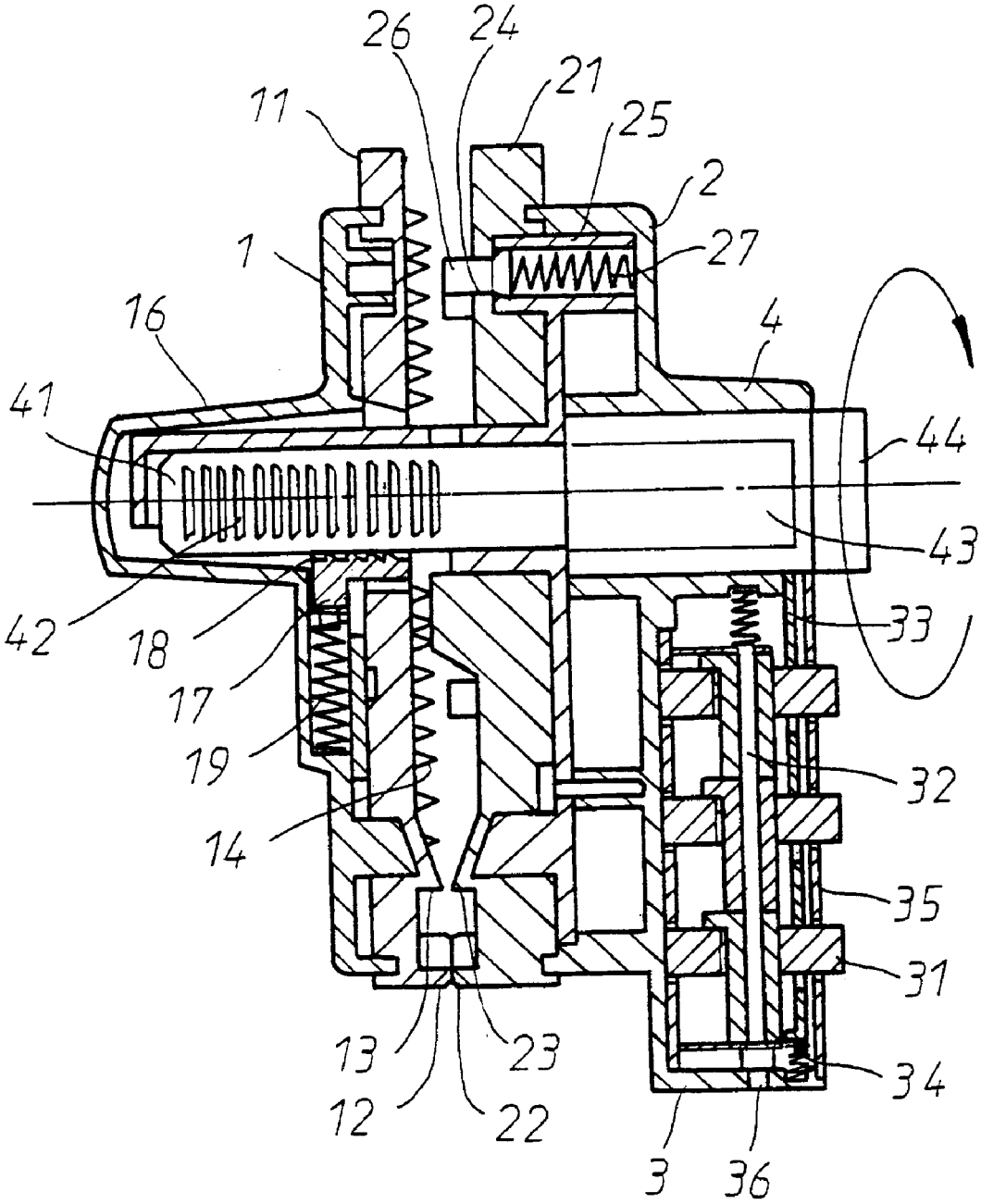
FIG. 4 is a sectional view showing the internal structure of the locking device at un-locking position in accordance with the present invention.

Referring to FIGS. 1, 2 and 3, the locking device of the present invention comprises a first clipping seat 1 and a second clipping seat 2, wherein the first clipping seat 1 is provided with a hollow seat 16 having a stopping block 17 mounted with a plurality of ratchet wheels 18, one edge of the stopping block 17 is urged by the spring force of a spring 19 such that the ratchet wheel 18 of the stopping block 17 is protruded into the hollow seat 16. The second clipping seat 2 is provided with a locking seat 3, which is an extension of the clipping seat 2 at one lateral edge thereof. The locking seat 3 contains a number combination locker consisting of a plurality of numeral wheels 31, a retractable shaft 32, a control board 33, a plurality of springs 34, and a covering plate 35.

In accordance with the present invention, one edge of the locking seat 3 is formed as one unit and is extended to form a geared-shaft slot 4 for the insertion of a geared-shaft 41, and the geared-shaft 41 is rotatable within the geared-shaft slot 4. The plurality of ratchet wheels 42 are provided on the geared-shaft 41. On the end face of the geared-shaft 41, a rotating button 44 is mounted. The end of the geared-shaft 41 containing the ratchet wheel 42 is protruded to the other edge of the second clipping seat 2.

FIGS. 2 and 3 show the internal structure of the locking device at the locking position in accordance with the present invention. The first and the second clipping seat 1, 2 respectively cover the lateral side of the trigger and trigger guard of a pistol and combine together with the hollow slot 16 and the geared-shaft 41, such that when the geared shaft 41 of the second clipping seat 2 is inserted into the hollow seat 16 of the first clipping seat 1, the ratchet wheels 42 are in engagement with the ratchet wheels 18 of the stopping block 17, and the cut face 43 of the geared-shaft 41 is pressed against by the control board 33 of the number combination locker such that the movement of the geared shaft 41 is restricted. This is at the locking position in accordance with the present invention. Thus, the trigger of the pistol is locked in between the first clipping seat 1 and the second clipping seat 2 and the pistol cannot be triggered by others.

Referring to FIG. 3, there is shown the internal structure of the locking device at the unlocking position in accordance with the present invention. When the numeral wheels 31 are turned to a correct combination number, the control board 33 will not restrict by the numeral wheels 31 and the control board 33 is free to move independently. Thus the cut face 43 of the geared shaft 41 will not be pressed against by the control board 33 and the rotating button 44 can drive the geared shaft 41. Thus, the ratchet wheels 42 of the geared shaft 41 are rotated and are separated from the engagement with the ratchet wheels 18 of the stopping block 17. Thus, the first clipping seat 1 and the second clipping seat 2 can be easily separated and the locking device is at the unlocking position.

In accordance with the present invention, the number combination of the number combination locker can be varied. When the locking device is at the unlocking position, and a sharp pointer 3 is inserted into a tiny hole 36 at the lateral side of the locking seat 3, the retractable shaft 32 will retract backward. The numeral wheels 31 are then dialled to form another combination number, and then release the sharp pointer, the new combination number is thus set. In accordance with the present invention, the locking device allows the owner of the pistol to set a secret combination number which can be easily memorized. The locking device provides the owner a security to the pistol to avoid being used by others.

Various modifications may occur to those skilled in the art without departing from the spirit and scope of the invention as defined by the appended claims.

What is claimed is:

1. A locking device for the trigger of a pistol comprising a first and a second clipping seat, wherein the first clipping seat is provided with a hollow seat having a stopping block mounted with a plurality of ratchet wheels, the second clipping seat is provided with a locking seat and a geared-shaft slot, and a number combination locker is provided to the locking seat, a geared-shaft is provided to the geared-shaft slot and is mounted with a plurality of ratchet wheel, and the geared-shaft is adaptable to the hollow seat, a cut face is provided to a circular end of the geared-shaft, and a top face of the geared-shaft is provided with a rotating button, such that when the cut face is restricted by a control board of the number combination locker, the geared-shaft cannot be rotated and a trigger is at a locking position, and when number wheels of the number combination locker is rotated to a correct number, the control board is free to retract and the cut face of the geared-shaft is not engaged with the control board, the geared-shaft is then free to rotate, and the ratchet wheel of the geared-shaft and the ratchet wheel with a stopping block is thus disengaged and the trigger is at an unlocking position, the number combination locker comprises a plurality of numeral wheels, a retractable shaft, a control board, a plurality of spring, and a covering plate, the control board is controlled by the numeral wheels of the number combination locker to urge the control board to press against the cut face of the geared-shaft, the control board is controlled by the numeral wheels of the numeral locker to urge the control board to release from pressing against the cut face of the geared-shaft, a plurality of springs are provided at one lateral edge of the control board, a hole is provided to a lateral edge of the numeral locker which allows the insertion of a sharp pointer to retract the retractable shaft in order to set a number combination for the number combination locker.

* * * * *